US007223927B2

(12) United States Patent
Poyner

(10) Patent No.: US 7,223,927 B2
(45) Date of Patent: May 29, 2007

(54) LOCKABLE SWITCH MECHANISM

(75) Inventor: Julian Poyner, Hazel Grove (GB)

(73) Assignee: EJA Limited, Hindley Green, Wigan (GB)

( * ) Notice: Subject to any disclaimer, the term of this patent is extended or adjusted under 35 U.S.C. 154(b) by 0 days.

(21) Appl. No.: 11/478,477

(22) Filed: Jun. 29, 2006

(65) Prior Publication Data

US 2007/0000765 A1 Jan. 4, 2007

(30) Foreign Application Priority Data

Jul. 2, 2005 (GB) ..... 0513651.0

(51) Int. Cl.
*H01H 9/00* (2006.01)

(52) U.S. Cl. ..... 200/43.04; 200/43.07; 200/300; 200/325

(58) Field of Classification Search ..... 200/17 R, 200/43.01, 43.04, 43.07, 43.08, 43.09, 43.16, 200/43.19, 573, 300, 61.08, 318, 318.1, 320, 200/323, 324, 325, 329, 334
See application file for complete search history.

(56) References Cited

U.S. PATENT DOCUMENTS 5,062,668 A 11/1991 Onderka et al.
5,868,243 A * 2/1999 Bachle ..... 200/334
5,894,116 A * 4/1999 Da Dalt ..... 200/43.04
6,483,053 B2 * 11/2002 Kajio et al. ..... 200/43.07
6,872,898 B2 * 3/2005 Mohtasham ..... 200/43.01
6,982,391 B2 * 1/2006 Da Dalt ..... 200/43.04

FOREIGN PATENT DOCUMENTS

| | | |
|---|---|---|
| CH | 501303 A | 12/1970 |
| EP | 1376632 A1 | 2/2004 |
| GB | 2091043 A | 7/1982 |

* cited by examiner

*Primary Examiner*—Michael A Friedhofer
(74) *Attorney, Agent, or Firm*—Keith M. Baxter; William R. Walburn

(57) ABSTRACT

A locking switch assembly includes a cam, a plunger, and a locking mechanism. The cam is rotatably attached to a frame assembly and an end of the plunger is constructed to follow a contour of the cam. The plunger is movable between a plunger first position and a plunger second position. A pin is biased against the plunger and movable between a pin first position and a pin second position and locks the plunger in the plunger second position when the pin is in the pin second position. A breakable arm prevents movement of the plunger from the plunger second position to the plunger first position unless a force above a selected amount is applied to the cam when the plunger is in the plunger second position.

20 Claims, 3 Drawing Sheets

LOCKABLE SWITCH MECHANISM

CROSS REFERENCE TO RELATED APPLICATION

This application claims priority under 35 U.S.C. §119 to United Kingdom Patent Application No.0513651.0 filed Jul. 2, 2005, the entirety of which is incorporated by reference herein.

FIELD OF THE INVENTION

The present invention relates to a lockable switch mechanism which may be used in for example a machine guard to prevent the opening of a door of the machine guard until predetermined conditions have been established.

BACKGROUND OF THE INVENTION

A lockable switch mechanism is described in European Patent Application No. 1376632. That mechanism comprises a switch plunger which is mounted in a housing and is displaceable relative to the housing along a predetermined axis between a first unlocked position and a second locked position. A locking mechanism is provided for locking the switch plunger in the second position and the switch plunger actuates a switch mechanism as a result of movement of the switch plunger between the first and second positions. The locking mechanism comprises two rolling element latches which are normally biased against the switch plunger so as to engage behind an axially facing surface defined by the switch plunger when the plunger has been moved to the second position. The rolling element latches can only be withdrawn so as to permit axial displacement of the switch plunger if a locking plate extending transversely of the switch plunger and having limbs extending in the axial direction of the switch plunger and engagable with a respective one of the rolling element latches is displaced to a latch release position. The latch releasing plate is driven directly by a solenoid which is disposed axially at one end of the switch mechanism housing. The arrangement is such that the switch will hold in its locked position despite the application of a considerable physical force in the opening direction. One particular design is arranged to withstand the application of a holding force of 1600N. It would require the effort of a stronger than average person to apply such an opening force. Hence the mechanism affords a latching mechanism that, prevents unintentional opening—such as is required for latches of safety gate for kinetic machines. However, a disadvantage of the known construction which arises from the relatively ductile material from which the locking element is made is that if the mechanism is loaded to such levels in its closed position it is possible for the locking element to deform without releasing the switch plunger and without tripping the associated electrical safety switch.

The consequence of this is that the holding force of the switch mechanism maybe considerably reduced. Thus a situation can arise where the mechanism has been subject to its indicated maximum load resistance but without providing any indication that this is the case. This may be disadvantageous in certain applications.

It is an object of the present invention to provide an improved lockable switch mechanism.

BRIEF DESCRIPTION OF THE INVENTION

According to the present invention, there is provided a lockable switch mechanism comprising a switch plunger which is mounted in a housing and is displaceable relative to the housing along a predetermined axis between a first unlocked position and a second position, a locking mechanism for locking the switch plunger in the second position, and a switch mechanism which is actuated by movement of the switch plunger between the first and second positions, wherein the locking mechanism comprises at least one first locking member which is biased against a surface of the switch plunger and at least one second locking member which is displaceable between locked and released positions, the surface of the switch plunger against which the first locking member is biased defining a profile arranged such that movement of the switch plunger from the second to the first position causes the profile to displace the first locking member, and the second locking member when in the locked position prevents displacement of the first locking member by the profile to thereby prevent movement of the plunger from the second to the first position, and further comprising a pair of electrical contacts for use in monitoring when the switch is in at least its locked position, and wherein the second locking member, when in the locked position, provides a conductive path between said pair of electrical contacts.

Preferably the second locking member includes a frangible element that will break at a predetermined loading thereby breaking the conductive path and signaling that the switch has been loaded up to its prescribed limit, so that in contrast to the mechanism described in European Patent Application No. 1376632, application of a force equal to the designed holding force causes the locking member to fracture, breaking the circuit and triggering a failure signal.

Preferably, the or each first locking member comprises a locking pin extending transversely relative to the axis of displacement of the switch plunger, the locking pin being spring biased towards the switch plunger in a direction perpendicular to the switch plunger axis. Two locking pins may be provided on opposite sides of the switch plunger. The locking pins may be mounted in a housing assembly defining an aperture through which the switch plunger extends, the locking pins being spring-biased towards each other from opposite sides of the aperture by springs supported in the housing assembly. The housing assembly may comprise a frame which receives the locking pins and springs and a cover plate which retains the locking pins and springs within the assembly.

Preferably the first locking members are of non-conductive material, so as not to create an undesired conductive path with the pair of electrical contacts.

The profile may be defined by an annular shoulder extending around the switch plunger. That shoulder may be tapered so as to readily lift the locking pins away from the switch plunger if the mechanism is not in the locked condition. The or each locking member may comprise a locking arm which is displaceable in a direction parallel to the switch plunger axis and, when in the locked position, extends on the side of the first locking member remote from the switch plunger to prevent displacement of the first locking member in a direction away from the switch plunger axis.

The second locking member may comprise arms extending in the axial direction. Two locking arms may be provided to lock respective locking pins against displacement relative to the switch plunger axis. The arms may project axially from a plate that is preferably acted on or secured to a solenoid plunger. The plate may be C-shaped. The locking arms may extend from one end of a solenoid plunger which is arranged at one end of the switch plunger and is displaced along the switch plunger axis by a solenoid winding within a solenoid housing. Preferably it is the arms which incorporate fracture points. The material from which the locking member is made is preferably one that is relatively brittle such that it will shear under load, rather than one which is ductile. A material having a hardness of say 40 on the Rockwell B Scale has been found suitable.

The fracture points may be provided by thinning of the arms. Such thinning is preferably nearer to the plate than the free ends of the arms. The thinning may take the form of v-shaped notches either in the facing sides of the arms or on outer sides of the arms.

The aforesaid solenoid may be arranged so that, when energised, the locking arms are displaced from the locked position, or alternatively may be arranged so that, when energised, the locking arms are displaced to the locked position.

A compression spring may be arranged between the switch and solenoid plungers to bias the plungers apart, and a compression spring may also be arranged between the solenoid plunger and the solenoid housing to bias the solenoid plunger towards the switch plunger. The switch plunger may be axially displaced by rotation of a cam from a datum position by insertion of an actuator into the mechanism, withdrawal of the actuator being prevented unless the cam is rotated back to the datum position, and such rotation being prevented by the locking mechanism if the or each second locking member is in the locked position.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
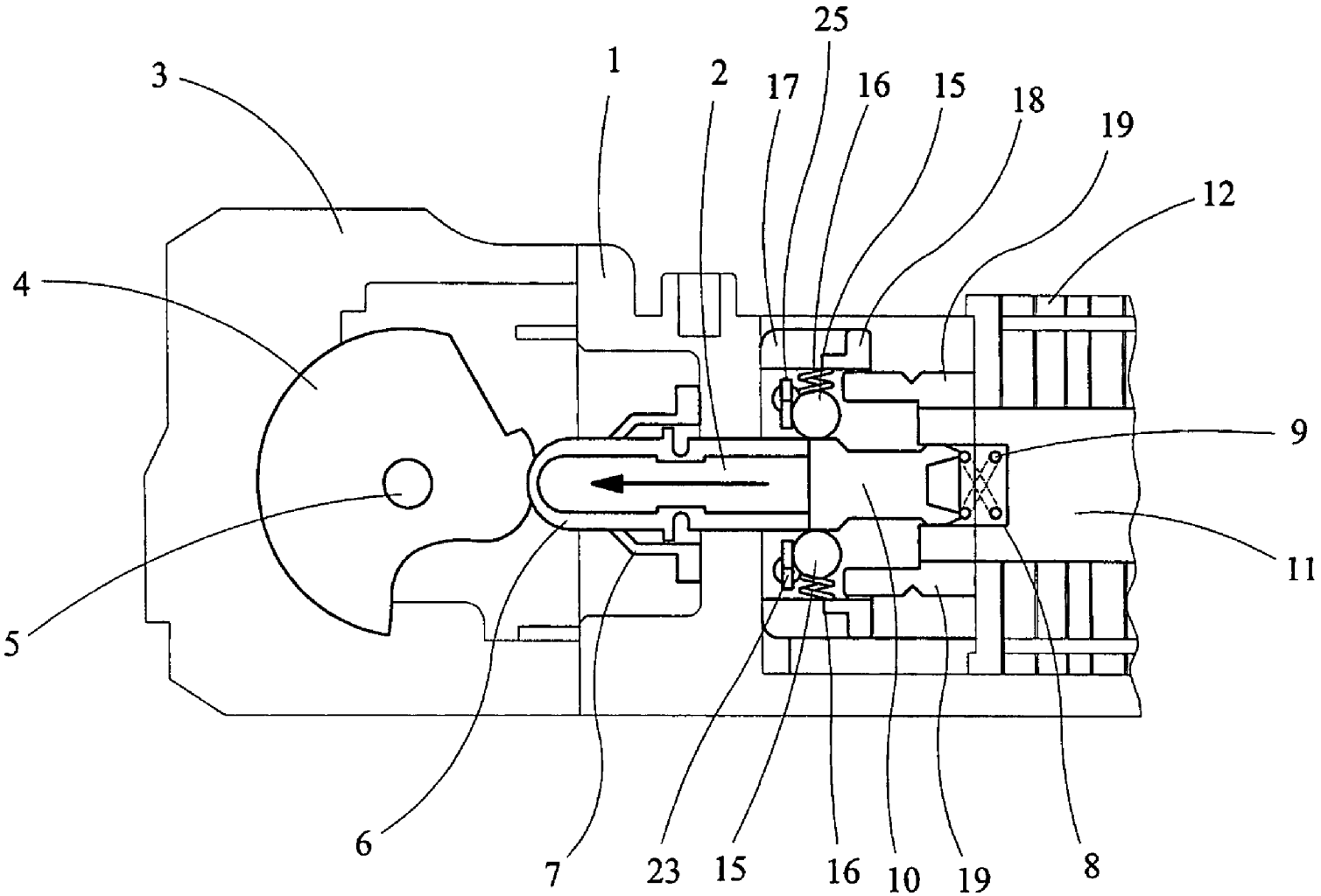
FIG. 1 is a cut away view of a locking switch mechanism in accordance with the present invention with the switch in an unlocked position.

Referring to FIG. 1, the illustrated lockable switch mechanism comprises a housing 1 in which a plunger 2 is slidable and which supports a head assembly 3 supporting a rotatable cam 4, the cam 4 being rotatable about a pin 5. The plunger 2 comprises a metal core supporting an outer casing 6 which is slidably received in a sealing cap 7. The plunger 2 is symmetrical about is longitudinal axis and is slidable relative to the housing 1 along that axis.

The end of the plunger 2 remote from the cam 4 is received in a bore 8, a compression spring 9 being located with the bore 8 so as to bias the plunger 2 in the direction indicated by an arrow 10. The bore 8 is formed in the end of a solenoid plunger 11 which is received with a solenoid housing 12. Energisation of a solenoid winding (not shown) in the solenoid housing 12 drives the solenoid plunger 11 to the right in FIG. 1. De-energisation of the solenoid results in the solenoid plunger 11 being moved to the left in FIG. 1 by a compression spring 13 (FIG. 2) which is located between the solenoid housing 12 and a locking fork 14 which is engaged in a groove extending around the end of the solenoid plunger 11 in which the bore 8 is formed.

Two locking legs or pins 15 are positioned on either side of the plunger 2, the locking pins 15 being biased by springs 16 against the plunger 2. The locking pins 15 and springs 16 are retained within a housing assembly made up from a frame 17 and a cover plate 18. It will be seen that with the plunger 2 in the position shown in FIG. 1 the pins 15 are held at a distance from the axis of the plunger 2 such that they obstruct the passage of arms 19 supported by the locking fork 14 in the direction of the arrow 10. The locking pins 15 are made of non-conductive material.

Figure 2:
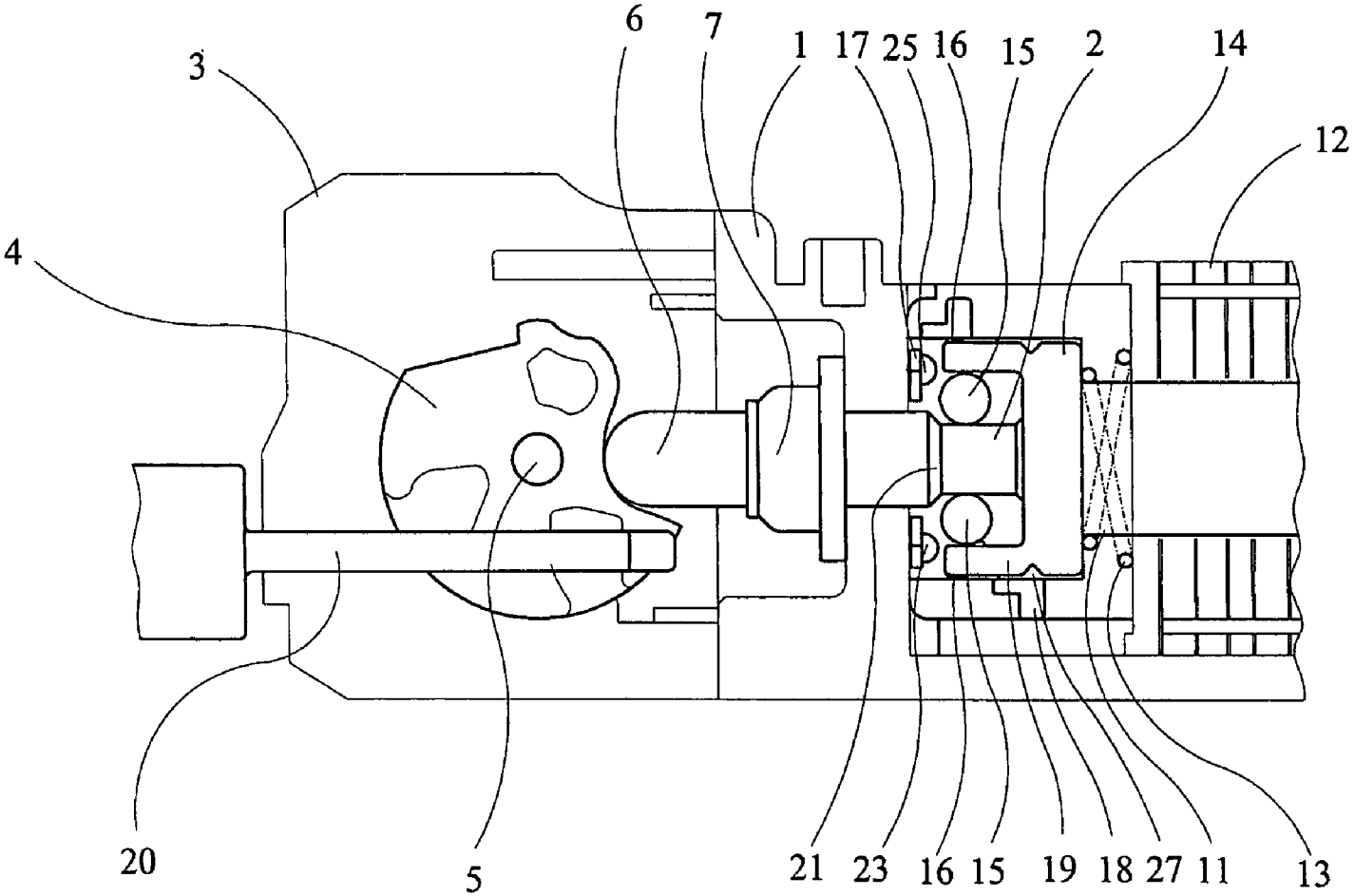
FIG. 2 is a cut away view of a locking switch mechanism in accordance with the present invention with the switch in its locked position.
Figure 3:
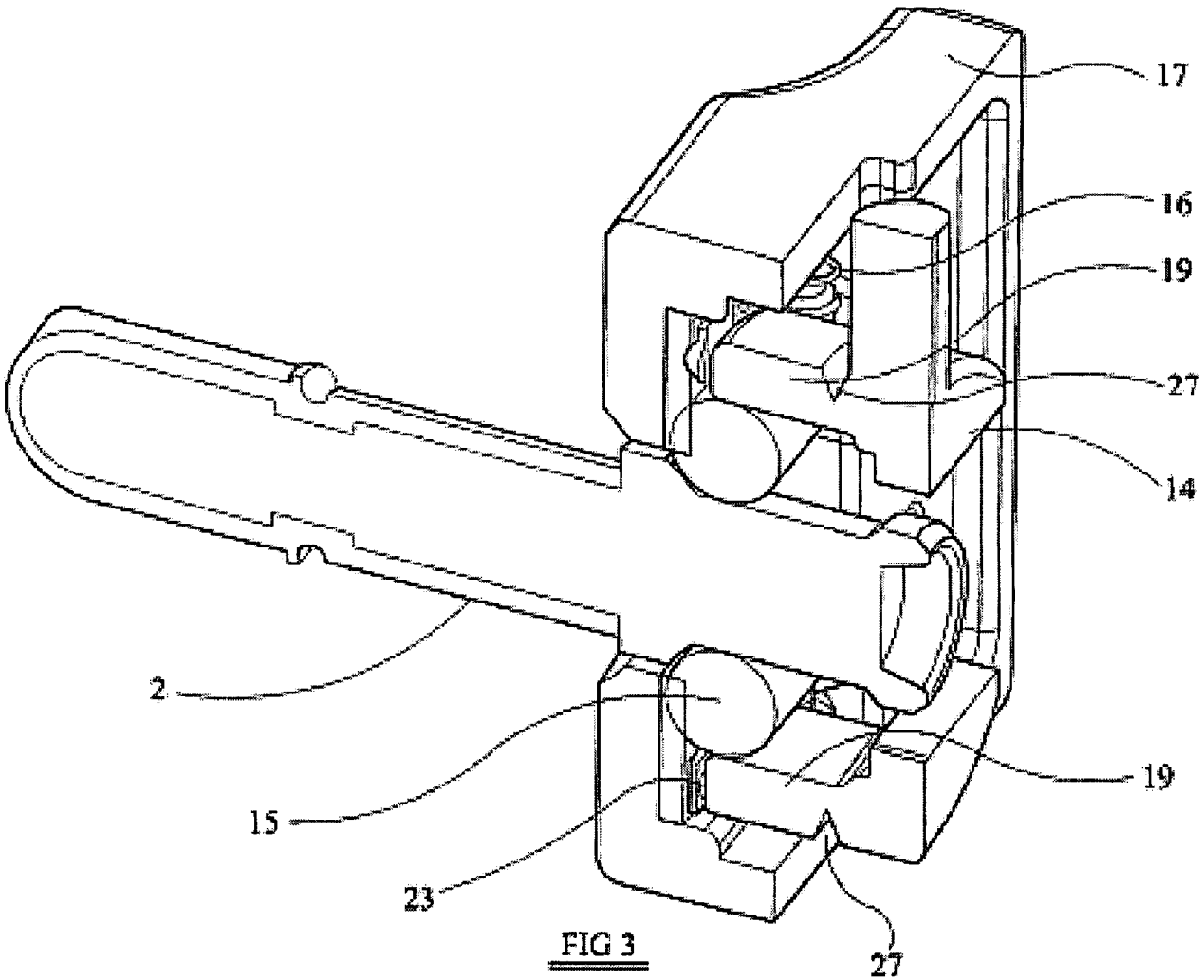
FIG. 3 is a cut away perspective view of the switch mechanism of FIGS. 1 and 2 to an enlarged scale.

FIG. 2 shows the assembly of FIG. 1 after the insertion of an actuator 20 into the head assembly 3 so as to cause rotation of the cam 4. Such rotation of the cam 4 enables the plunger 2 to move towards the pin 5. As a result, a shoulder, profiled shoulder, or profile 21 in the form of an annular shoulder on the plunger 2 is moved to the left of the locking pins 15. The locking pins 15 are biased towards each other so as to remain in contact with the plunger 2, thereby enabling the arms 19 of the locking fork 14 to pass the locking pins 15.

The actuator 20 and cam 4 are shaped such that insertion of the actuator into the head assembly 3 causes the cam to rotate from a datum position, that is the position of the cam 4 as shown in FIG. 1. In known manner, the actuator defines projections (not shown) which engage in recesses defined by the cam 4 (as shown in FIG. 2) so that once the cam 4 has been rotated from the datum position the actuator 20 cannot be withdrawn from the head assembly 3 unless the cam 4 has been rotated back to the datum position. An actuator and cam mechanism of this general type is described in U.S. Pat. No. 5,777,284.

In the unlocked condition of FIG. 1 the solenoid plunger 11 has been moved to the position it assumes when the solenoid is energised and the plunger 2 is in the position in which it is displaced by the cam 4 as far as possible towards the solenoid housing 12. As a result the spacing between the pins 15 is such that even if the solenoid is then deenergised the arms 19 cannot move past the pins 15. The pins 15 therefore impose no restraint on the axial displacement of the plunger 2. In contrast, as shown in FIG. 2, if the cam 4 is then rotated to displace the plunger 2 so that the pins 15 can drop down the profiled shoulder 21 defined by the plunger 2, the springs 16 urge the locking pins 15 towards each other so as to engage behind the shoulder 21. De-energisation of the solenoid then results in the arms 19 being extended past the pins 15, restraining the pins 15 against movement away from each other. Any attempt therefore to drive the plunger 2 towards the solenoid housing 12 will be resisted as a result of the pins 15 jamming between the profile 21 and the arms 19. The frame 17 carries a pair of electrical contacts 23, 25 having wires (not illustrated) leading therefrom to a monitoring circuit. The contacts are aligned axially with the ends of the arms 19 of the locking fork 14. The locking fork is formed of a conductive material. It will also be noted that the locking fork has a defined region of weakness or fracture point 27 where the arms 19 connect with the main body of the locking fork 14. In the illustrated embodiment the region of weakness is created by relieving the outer side of the arms of locking forks 14 but the relieving could be to the other side or both sides.

In the unlocked position of the switch shown in FIG. 1, the ends of the arms 19 are spaced from the contacts 23,25. However, in the locked position, as shown in FIG. 2, the ends of the arms 19 make contact with a respective one of the contacts 23, 25. Thus a circuit is made by the presence of the locking member. This presence of a circuit signals that the switch is locked and that the locking fork is intact.

However, if a force is applied to the plunger when in the locking position by way of the actuator, the profile of the plunger will apply a force to the pins 15 in a direction which will try to spread the legs 15 of the locking fork. Provided that the applied force is less than the designed load bearing capacity of the locking member, then this spreading force is resisted.

The locking fork is made from a material that exhibits low ductility, but high strength so as to resist deformation under load. However, when the arms are loaded up to their design limit, they will fracture at the fracture point 27. As a consequence the conduction path formed by the arms 19 of the locking fork will be broken and the monitoring circuit broken thereby signaling that the switch is no longer intact and that replacement is required.

This construction has the advantage that once the switch has been loaded up to its design limit it fails and there is an immediate indication of fracture in contrast to designs where the arms spread under load whilst remaining intact and resulting in an unquantifiable but significantly reduced holding force.

What is claimed is:

1. A lockable switch mechanism comprising:

a switch plunger which is mounted in a housing and is displaceable relative to the housing along a predetermined axis between a first position and a second position;

a switch mechanism actuated by movement of the switch plunger between the first and second positions; and a locking mechanism for locking the switch plunger in the second position and comprising:

at least one first locking member that is biased against a surface of the switch plunger;

at least one second locking member that is displaceable between a locked position and a released position, a surface of the switch plunger against which the at least one first locking member is biased defining a profile arranged such that movement of the switch plunger from the second position to the first position causes the profile to displace the at least one first locking member, the at least one second locking member when in the locked position preventing displacement of the at least one first locking member by the profile to thereby prevent movement of the plunger from the second position to the first position; and a pair of electrical contacts for use in monitoring when the switch plunger is in the at least one second position, and wherein the second locking member, when in the locked position, provides a conductive path between said pair of electrical contacts.

2. The lockable switch mechanism of claim 1 wherein the at least one second locking member includes a frangible element that will break at a predetermined loading thereby breaking the conductive path and signaling that the switch has been loaded to a prescribed limit.

3. The lockable switch mechanism of claim 1 wherein the at least one second locking member comprises at least one locking arm.

4. The lockable switch mechanism of claim 1 wherein the housing assembly comprises a frame that receives the at least one first locking member and wherein the pair of electrical contacts are accommodated within the frame.

5. The lockable switch mechanism of claim 1 wherein the at least one second locking member further comprises a pair of locking arms which are displaceable in a direction parallel to an axis of the switch plunger and, when the switch plunger is in the second position, ends of the arms contact a respective one of said contacts.

6. The lockable switch mechanism of claim 5 wherein the locking arms extend from one end of a solenoid plunger that is arranged at one end of the switch plunger and is displaceable along the switch plunger axis by a solenoid winding within a solenoid housing.

7. The lockable switch mechanism of claim 5 wherein at least one of the locking arms has a frangible section.

8. The lockable switch mechanism of claim 7, wherein the frangible section is further defined as a notch.

9. A locking switch assembly comprising:

a frame assembly;

a cam attached to the frame assembly for rotation of the cam;

a plunger having an end constructed to follow a contour of the cam and movable between a plunger first position and a plunger second position;

a least one pin biased against the plunger and movable between a pin first position and a pin second position for locking the plunger in the plunger second position when the at least one pin is in the pin second position; and at least one breakable arm for preventing movement of the plunger from the plunger second position to the plunger first position unless a force above a selected amount is applied to the cam when the plunger is in the plunger second position.

10. The locking switch assembly of claim 9 further comprising an electrical contact for indicating breakage of the at least one breakable arm.

11. The locking switch assembly of claim 9 further comprising another pin positioned on a side of the plunger generally opposite the at least one pin.

12. The locking switch assembly of claim 11 further comprising a spring engaged with each of the at least one pin and the another pin and constructed to bias the at least one pin and the another pin along a shoulder of the plunger.

13. The locking switch assembly of claim 9 wherein the at least one breakable arm includes a groove to define a point of breakage.

14. The locking switch assembly of claim 9 further comprising a solenoid constructed to move the at least one breakable arm.

15. A locking switch comprising:

a slidable plunger having a shoulder;

a cam for moving the slidable plunger;

a first locking member for securing a position of the slidable plunger;

a second locking member for securing a position of the first locking member and forming an electrical connection; and a breakpoint formed in the second locking member for severing the electrical connection when a force above a holding force is applied to the cam.

16. The locking switch of claim 15 wherein the shoulder, the first locking member, and the second locking member are oriented to change a direction of the force applied to the cam to a direction generally transverse to an axis of the plunger.

17. The locking switch of claim 15 further comprising at least one spring constructed to bias the first locking member in a direction that crosses an axis of the plunger.

18. The locking switch of claim 15 further comprising a spring constructed to bias the second locking member in a direction generally aligned with an axis of the plunger.

19. The locking switch of claim 15 wherein the breakpoint is a groove formed in an arm of the second locking member and positioned on the arm away from the first locking member.

20. The locking switch of claim 15 wherein the second locking member is replaceable after fracture of the breakpoint.

* * * * *